US009636526B2

(12) United States Patent
Galyan

(10) Patent No.: US 9,636,526 B2
(45) Date of Patent: May 2, 2017

(54) FRICTIONAL ROPE CONTROL DEVICE WITH ON THE FLY FRICTION ADJUSTMENT

(71) Applicant: Randall Luke Galyan, Las Vegas, NV (US)

(72) Inventor: Randall Luke Galyan, Las Vegas, NV (US)

( * ) Notice: Subject to any disclaimer, the term of this patent is extended or adjusted under 35 U.S.C. 154(b) by 0 days.

(21) Appl. No.: 14/603,357

(22) Filed: Jan. 23, 2015

(65) Prior Publication Data

US 2016/0213953 A1 Jul. 28, 2016

Related U.S. Application Data

(60) Provisional application No. 61/931,543, filed on Jan. 24, 2014.

(51) Int. Cl.
*A62B 1/08* (2006.01)
*A62B 1/14* (2006.01)

(52) U.S. Cl.
CPC ..... *A62B 1/14* (2013.01)

(58) Field of Classification Search
CPC .... A62B 1/00; A62B 1/06; A62B 1/14; F16B 45/02; A63B 29/00
USPC ..... 24/115 R, 129 B, 134 R, 376
See application file for complete search history.

(56) References Cited

U.S. PATENT DOCUMENTS 316,870 A 4/1885 Braunfeld
785,019 A 3/1905 Parker
1,205,496 A * 11/1916 Whitehead ..... F16G 11/00 24/129 R
1,383,665 A * 7/1921 Rohan ..... F16G 11/14 24/129 B
1,426,537 A * 8/1922 Bauer ..... F16G 11/14 24/130
1,565,041 A * 12/1925 Arney ..... F16G 11/14 24/129 R
1,806,162 A * 5/1931 Hahn ..... A43C 7/04 24/129 B
3,309,745 A * 3/1967 Gintz ..... H02G 7/056 174/79
3,656,745 A 4/1972 Holkesvick
3,678,543 A * 7/1972 Hobbs ..... A62B 1/04 182/191

(Continued)

FOREIGN PATENT DOCUMENTS

EP 1312391 5/2003

*Primary Examiner* — Robert J Sandy
*Assistant Examiner* — David Upchurch

(57) ABSTRACT

A rappelling device that frictionally controls rope flow, thereby allowing adjustable control of a load relative to an anchor is disclosed. For example, a coupling link, such as a carabiner, is clipped into a small hole, a bight of rope is pushed through a separate large hole, and then the rope is clipped into the carabiner. A user may use the rappelling device to increase the friction while the rope is weighted by weaving the rope through one or more openings on the device. In doing so, the user does not need to feed the end of the rope through the one or more openings. The rappelling device provides incremental adjustment of friction while the rope is weighted. Additionally, a gland cut into the inner circumference of the small hole may be added to grip and limit axial movement of the carabiner.

15 Claims, 10 Drawing Sheets

(56) References Cited

U.S. PATENT DOCUMENTS 4,678,059 A * 7/1987 Bowker ..... A62B 1/04 182/5
4,723,634 A * 2/1988 Fisk ..... A62B 1/04 182/5
4,774,742 A * 10/1988 Johnson ..... A62B 1/04 24/129 B
4,910,834 A * 3/1990 Minkler ..... B60P 7/0823 24/129 A
4,941,434 A * 7/1990 Ellwanger ..... A01K 27/005 119/771
5,217,092 A * 6/1993 Potter ..... A62B 1/04 188/65.1
5,467,845 A 11/1995 Scruggs
5,511,291 A 4/1996 Crawford
D376,095 S * 12/1996 Curtis ..... D8/356
5,625,925 A * 5/1997 Richards ..... B60P 7/0823 24/129 B
5,671,822 A * 9/1997 Phillips ..... A62B 1/04 182/191
6,095,282 A * 8/2000 Sadeck ..... A62B 1/04 182/191
6,192,558 B1 * 2/2001 Badura ..... F16B 45/02 24/599.1
6,336,260 B1 * 1/2002 Mauthner ..... F16B 45/02 24/376
D458,533 S 6/2002 Sonju
6,959,783 B2 11/2005 Kwak et al.
7,143,708 B1 * 12/2006 Cimino ..... B63B 59/02 114/218
7,353,766 B1 * 4/2008 Wiese ..... B63B 21/045 114/218
8,209,823 B2 7/2012 Apicella
8,495,800 B2 7/2013 Lipke
8,568,190 B2 * 10/2013 Nelson ..... A63H 27/10 24/129 R
8,661,624 B1 * 3/2014 Bracewell ..... B63B 21/08 24/129 B
D716,132 S * 10/2014 Gobbi ..... D8/356
8,864,797 B2 * 10/2014 Justin ..... A61B 17/0487 606/232
2006/0168772 A1 * 8/2006 Sorensen ..... B60P 7/0823 24/130
2010/0031479 A1 * 2/2010 Apicella ..... A62B 1/14 24/129 R
2011/0173780 A1 * 7/2011 Lipke ..... A62B 1/06 24/115 R
2011/0258815 A1 * 10/2011 Everette ..... A62B 1/14 24/134 R
2013/0145582 A1 * 6/2013 Chupp ..... F16G 11/12 24/129 R

* cited by examiner

FRICTIONAL ROPE CONTROL DEVICE WITH ON THE FLY FRICTION ADJUSTMENT

This application claims the benefit of Applicants' prior provisional application, No. 61/931,543, filled on Jan. 24, 2014.

BACKGROUND OF THE INVENTION

Ropes are an essential part of a wide variety of professional and recreational activities where rope work is required. The need often exists for a user to use a rope to control the movement of a load relative to an anchor point.

The construction and use of general purpose rope rigging devices such as tackle blocks, belay devices, ascenders, carabiners, and pulleys are well-known. In addition, numerous rigging devices have been developed specifically to facilitate the use of ropes to frictionally control movement of a load relative to an anchor point.

Various improvements have been made with the addition of various tabs, horns or protrusions to manipulate rope flow and vary the amount of friction. Though such devices have achieved considerable popularity and commercial success, there has been a continuing need for improvement. New rope materials and construction techniques have produced ropes with less friction resulting in an increased need for improvement. The need exists for lightweight rope control devices that may be used in a variety of configurations to frictionally control rope movement rope to allow a load to be moved relative to an anchor point and allow safe adjustment over a range of friction while the device is weighted.

The Applicant is aware of the following rope control devices that are currently available in the marketplace.

A class of devices generally known as a "FIG. 8" is a flat plate defining first and second holes. A class of devices known as "Brake Racks" is also known in the art. These devices generally comprise an external frame formed by a U-shaped piece of metal that defines first and second legs and one or more cross-bars that can be pivoted about the first leg of the frame into a locked or unlocked position relative to the second leg of the frame.

These devices allow rope movement to be controlled using friction between the device and the rope.

BRIEF SUMMARY OF THE INVENTION

The present invention overcomes disadvantages common to some attempted solutions. The disadvantages are as follows:

Problem 1: Advances in rope technology now produce ropes that are thinner, suppler and slicker than before, resulting in less friction. Many people find their rappel devices offer insufficient total friction. Larger people often need extra rigging to combat the lower friction provided by newer ropes.

Problem 2: Few rappel devices provide a wide enough range of friction capable of meeting the needs of large and small people. Some people choose a specific device based solely on the amount of friction the device provides without regard to other positive factors.

Problem 3: With current rappel devices large people prefer to rappel double strand rather than single strand on thin rope due to insufficient friction resulting from the thin rope. Rappelling on a single strand of rope offers multiple safety benefits as compared to double strand rappel. Larger people frequently choose to rappel double strand knowing they forfeit some of the safety benefits of a single strand rappel in an attempt to create sufficient friction to safely control their body mass.

Problem 4: Few rappel devices provide a safe way to adjust the friction of the device in safe usable increments on the fly while the device is loaded or weighted. The inability to easily and safely add or remove just the right amount of friction while the device is weighted can lead to unsafe conditions while rappelling, belaying or lowering. The majority of rappel devices that do have a means to adjust the level of friction are only able to adjust in increments that are too large to be realistically useful to the user.

Therefore, an object of the present invention is to provide a rappel device with a range of friction which can accommodate large and small people on the majority of common rope sizes and construction, with either single or double strand rappelling techniques.

Another object of the present invention is to provide a rappel device which allows the user to adjust through the entire range of friction in usable increments while the rappel device is in use and weighted with a load.

To achieve the above-described objects, the present invention provides a rappel device with a first hole, a second hole and an extension with 2 or more openings for on the fly friction adjustment. A tab may also be included to assist in subbing the rope for locking off. Additionally a gland may be cut into the inner circumference of the second hole suitable to retain an o-ring inserted in the gland. The o-ring will help keep a carabiner inserted in the second hole in place by limiting the axial movement of the carabiner.

The advantages of the present invention are: (1) the rappel device provides a wide range of friction allowing large and small people to safely use single or double rope in the majority of common rope sizes and construction; (2) the user can adjust to any desired setting throughout the entire range of friction in usable increments while the device is in use and weighted with a load.

REFERENCES CITED

These cited references and all other referenced patents and applications are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

The following European Patent shows one popular form of a rappel device:

| | | |
|---|---|---|
| EP 1312391 A1 | BERNARD CONTAT | 2001 |

The following United States patents show other variations of rappel devices:

| | | |
|---|---|---|
| 8,495,800 | LIPKE | 2013 |
| 8,209,823 | APICELLA | 2012 |
| 7,866,634 | LIPKE | 2011 |
| 6,959,783 | Kwak | 2005 |
| D458,533 | SONJU | 2002 |
| 6,095,282 | SADECK | 2000 |
| 5,671,822 | PHILLIPS | 1997 |
| 5,511,291 | CRAWFORD | 1996 |
| D376,095 | CURTIS | 1996 |

-continued

| | | |
|---|---|---|
| 5,467,845 | SCRUGGS | 1995 |
| 5,217,092 | POTTER | 1993 |
| 4,723,634 | FISK | 1988 |
| 4,774,742 | JOHNSON | 1988 |
| 4,678,059 | BOWKER | 1987 |
| 3,656,745 | HOLKESVICK | 1972 |
| 3,678,543 | HOBBS | 1972 |
| 785,019 | PARKER | 1905 |
| 316,870 | BRAUNFELD | 1885 |

USPTO classifications this device may fit into: A62B 1/00, A62B 1/06, A62B 1/14 and A63B 29/00

BRIEF DESCRIPTION OF THE DRAWINGS

Although the invention is briefly summarized, a fuller understanding of the invention can be obtained by referencing the drawings and detailed description.

DETAILED DESCRIPTION OF THE INVENTION

Figure 1:
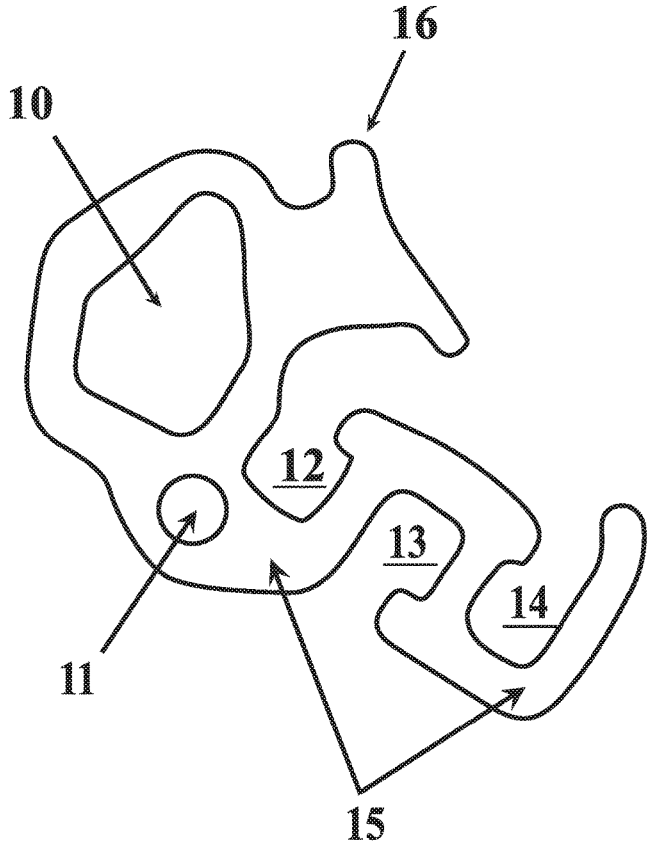
FIG. 1 is a view which depicts the device according to one possible embodiment of the invention, showing the device only.

It is advantageous to define several terms before describing the invention. It should be appreciated that the following definitions are used throughout the application.

Where the definition of terms departs from the commonly used meaning of the term, applicant intends to utilize the definitions provided below, unless specifically indicated.

Definitions

For the purposes of the present invention, directional terms such as "up", "down", "top", "bottom", "above", "below", "left", "right", "horizontal", "vertical", etc. are merely used for convenience in describing the various embodiments of the present invention. The embodiments of the present invention may be oriented in various ways.

For the purposes of the present invention, the term "rappel device" refers to a device which allows rope to be directed through the device to frictionally control movement of a load relative to an anchor point which may take the form of a sliding descent down the rope, lowering a load or belaying a second user.

For the purposes of the present invention, the term "lock off" refers to the user snubbing the rope using the device to completely stop movement of the device in relation to the rope.

For the purposes of the present invention, the term "snub" "or snubbing" refers to checking, arresting or stopping the rope from movement relative to the device.

For the purposes of the present invention, the term "on the fly" refers to the time the device is weighted by a load.

For the purposes of the present invention, the term "bight" refers to a bend or loop in the rope(s) at any point between the rope ends.

For the purposes of the present invention, the term "hole" refers to a void through the device that is fully encompassed and may be round or take on any other overall shape. An example would be the shape of the letter O.

For the purposes of the present invention, the term "opening" refers to a void through the device that is not fully encompassed and may be round or take on any other overall shape. An example would the shape of the letter C.

For the purposes of the present invention, the term "weave" refers to directing the rope through, along or around a portion of the device in various configurations.

For the purposes of the present invention, the term "carabiner" refers to coupling link used to connect the device to a load or another piece of equipment.

For the purposes of the present invention, the term "tab" refers to a protrusion suitable to allow the rope to be placed between the protrusion and the device.

For the purposes of the present invention, the term "o-ring" refers to a continuous ring made of a compressible resilient material.

For the purposes of the present invention, the term "gland" refers to a groove or channel cut into the device with dimensions suitable to retain an o-ring.

For the purposes of the present invention, the term "belay loop" refers to a secure connection point to a user's harness and/or a secure connection point to a load.

For the purposes of the present invention, the term "load" refers to an animate or inanimate object being moved relative to the anchor point and can take many different forms such as supplies, equipment, people, and/or, in the case of rappelling, the person using the rope.

For the purposes of the present invention, the term "anchor point" or "anchor" refers to the point that the rope is secured and is typically, but not necessarily, structurally fixed such as a tree, building, or the like, and the load is moved relative to the anchor point. However, the anchor point may be formed on a movable object such as a motor vehicle, helicopter or ship.

Description

While the invention has been described and illustrated with respect to an example of a preferred embodiment of the current invention, it is to be understood, this embodiment should be considered as illustrative rather than limiting. Various modifications and additions may be made and will be apparent to those skilled in the art. Accordingly, the invention should not be limited by the foregoing description, but rather should be defined only by the following claims.

Referring initially to FIG. 1 of the drawings, depicted is a rappel device preferably made of but not limited to aluminum, steel, titanium, stainless steel, plastic, composites and/or combinations thereof. Selection of an appropriate material will be made for a particular market and/or operating environment based on factors such as cost, strength, heat dissipation, wear resistance, corrosion resistance, and weight. The device has no moving parts and can be set for right or left handed use.

Although the present invention has been depicted in the drawings utilizing a single rope, it is to be understood that the device may also be used with two ropes in the same fashion. Using the device with two ropes is to be understood as included within the scope of the present invention.

The device can be used for, but not limited to, rappelling, abseiling, belaying, lowering, line tensioning, ascending and other climbing or rope rescue techniques on single or double rope. The device can be used in, but not limited to, activities such as canyoneering, rock climbing, rope rescue, caving, mountaineering, alpinism, aerial hiking, tree climbing, acrobatic work, stage work, health and safety and construction in the context of sporting, recreational, professional, law enforcement and military activities.

The device establishes unique improvements on current rappel device designs by providing a range of friction sufficient to accommodate large and small people on many common rope sizes and construction, provides sufficient friction in single or double rope configurations and allows the full range of friction adjustment in safe usable increments while the device is weighted. Friction may be adjusted by weaving the rope on the extension in various configurations.

Referring to FIG. 1 of the drawings, depicted is one possible embodiment of the present invention which has a first hole 10 large enough to pass a bight of rope through, a second hole 11 allowing attachment of a carabiner, an extension 15 with two or more openings 12, 13, 14 to weave the rope on for friction adjustment and a tab 16 to assist in lock off.

Figure 2:
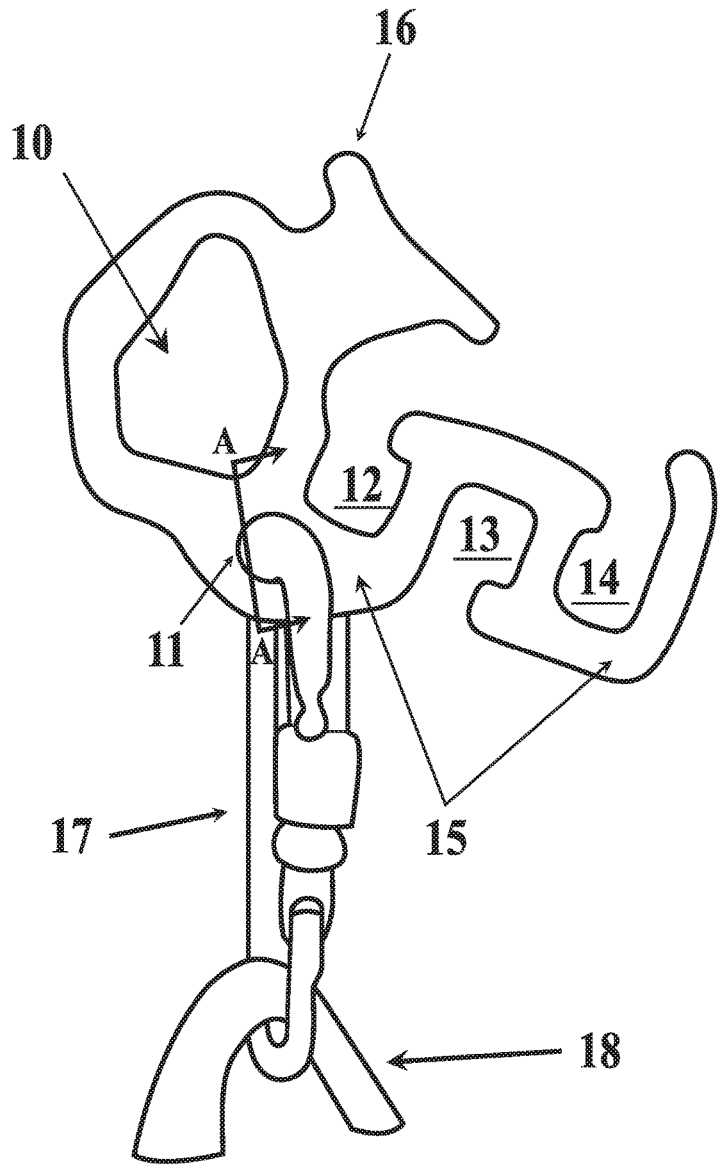
FIG. 2 is a view which depicts the device with a carabiner used to attach the device to a load.

Referring to FIG. 2 of the drawings, depicted is the device attached to a load. To attach the device to a load, attach a carabiner 17 to the belay loop or load 18, attach the device to the carabiner 17 using the carabiner hole 11.

Although the present invention is depicted in the drawings with a load connected to the device at the second hole the device may also be used with the anchor point attached to the device at the second hole which would be the preferred configuration in some lowering scenarios.

Figure 3:
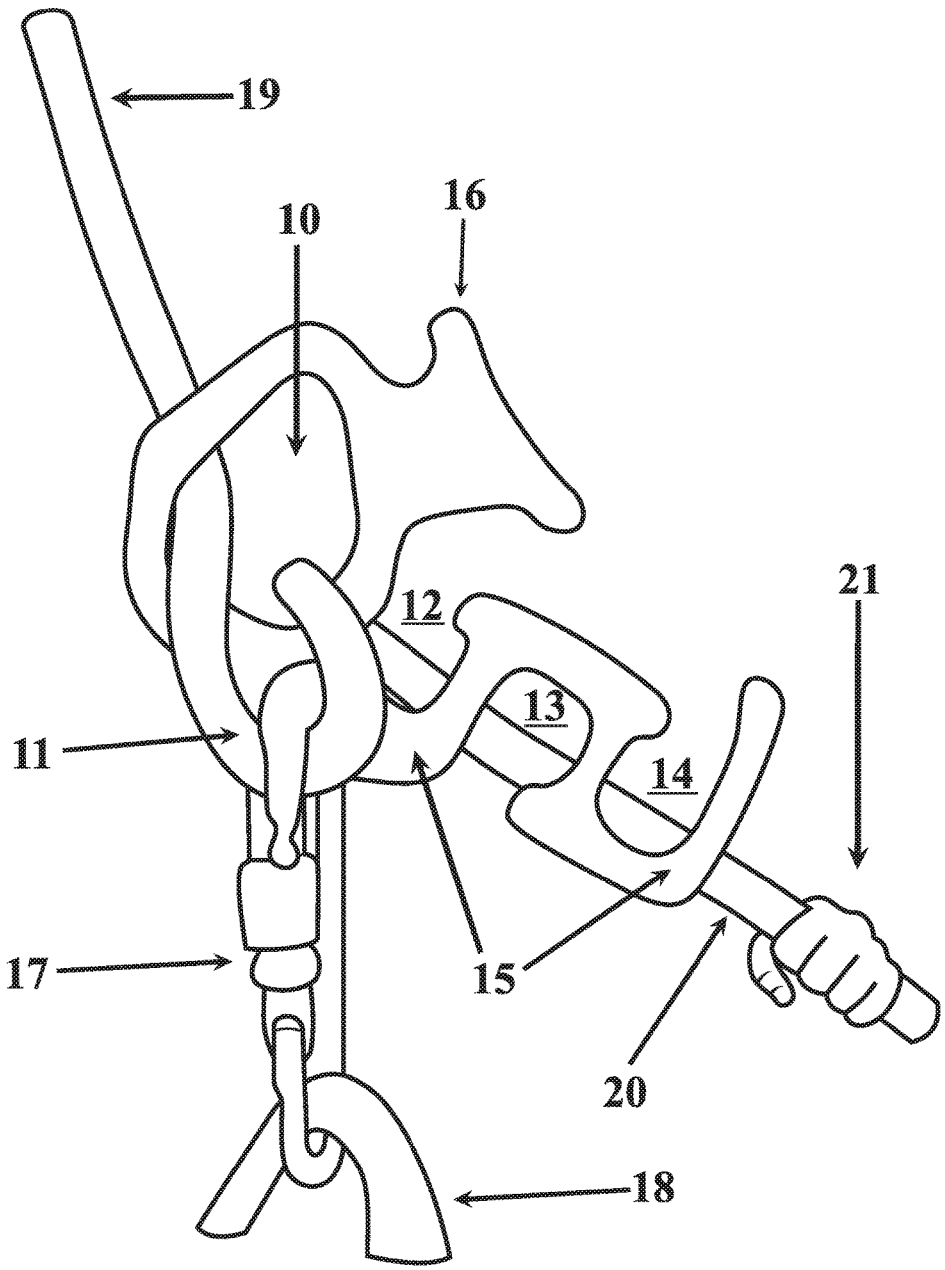
FIG. 3 is a view which depicts the device rigged with a single rope set ready to control a load and the rope is clipped into the carabiner.

Referring to FIG. 3 of the drawings, depicted is the device set ready to control a load using a single rope and the rope is clipped into the carabiner. To set the device ready to control a load, attach the device to the load as depicted in FIG. 2, create a bight in the rope 19, push the bight through the first hole 10, clip the rope 19 to the carabiner 17.

Figure 4:
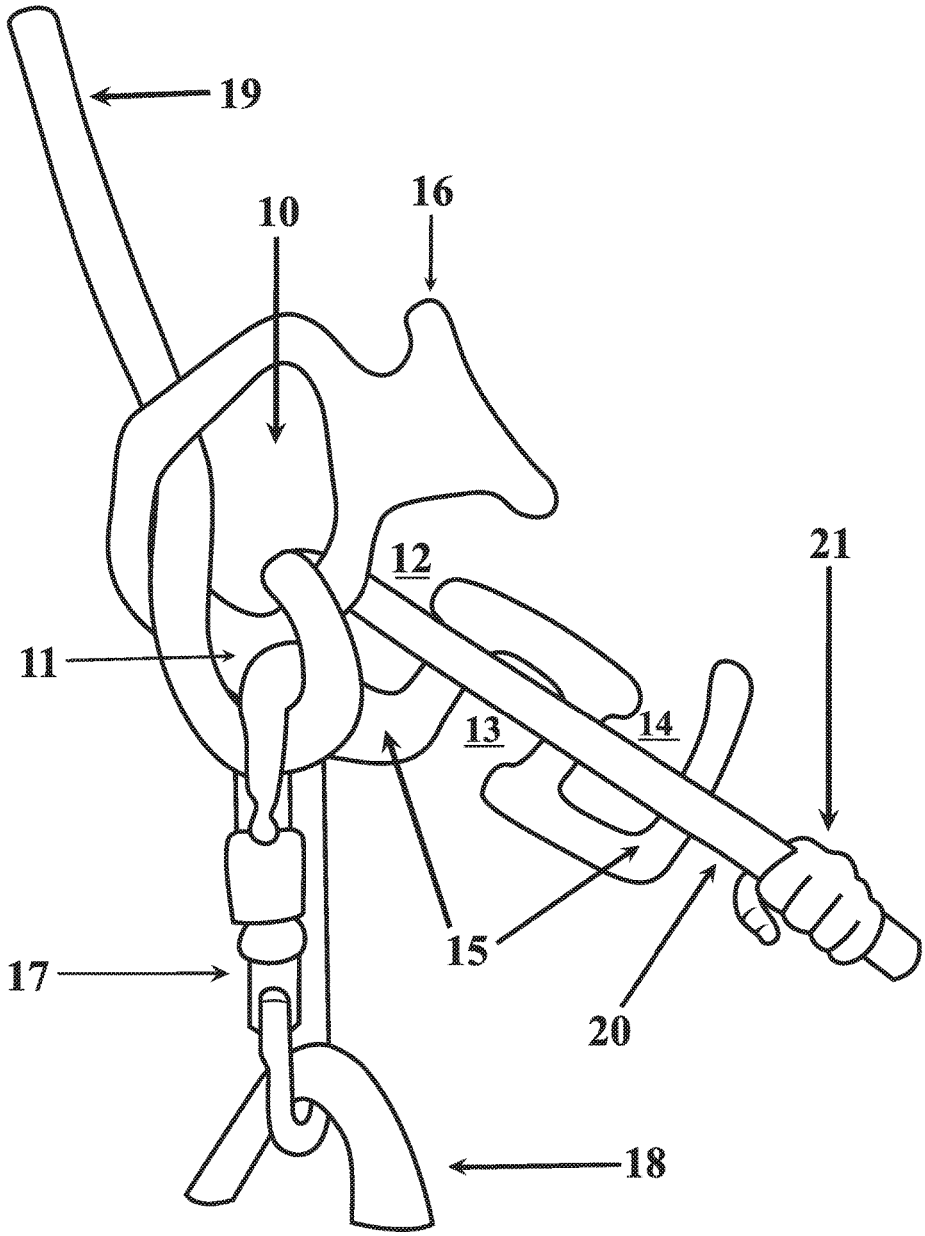
FIG. 4 is a view which depicts the device rigged with rope set ready to control a load and a first additional level of friction added.

Referring to FIG. 4 of the drawings, depicted is the device set with one additional level of friction. To set the device with one additional level of friction, attach the device to the load as depicted in FIG. 2, set the device ready to control the load as depicted in FIG. 3, a user's hand 21 then pulls the brake strand of rope 20 up into the first opening 12 in the extension 15.

Figure 5:
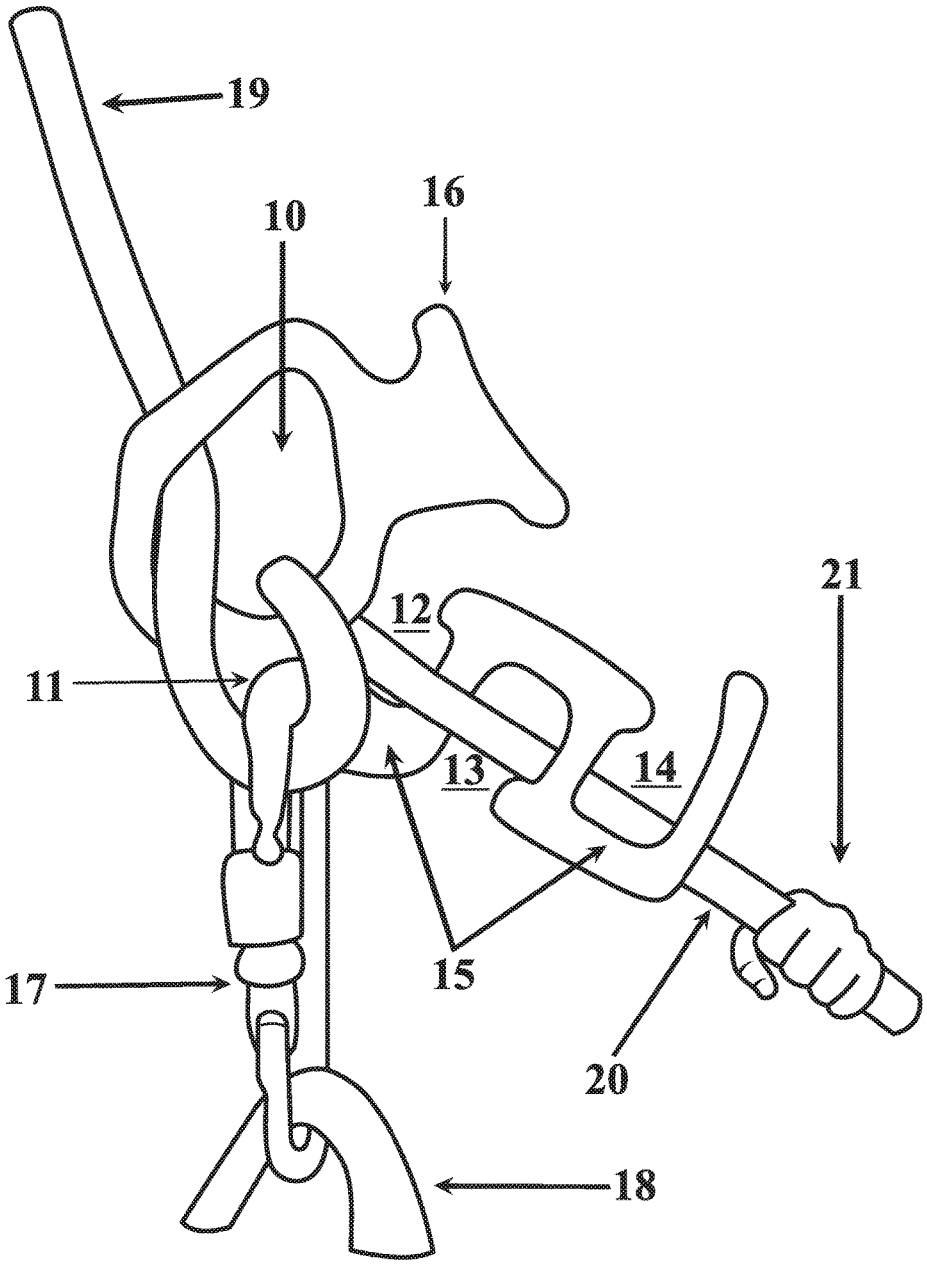
FIG. 5 is a view which depicts the device rigged with rope set ready to control a load and a second additional level of friction added.

Referring to FIG. 5 of the drawings, depicted is the device set with a second additional level of friction. To set the device with a second additional level of friction, attach the device to the load as depicted in FIG. 2, set the device ready to control the load as depicted in FIG. 3, set the device with one additional level of friction as depicted in FIG. 4, a user's hand 21 then pulls the brake strand of rope 20 down into the second opening 13 in the extension 15.

Figure 6:
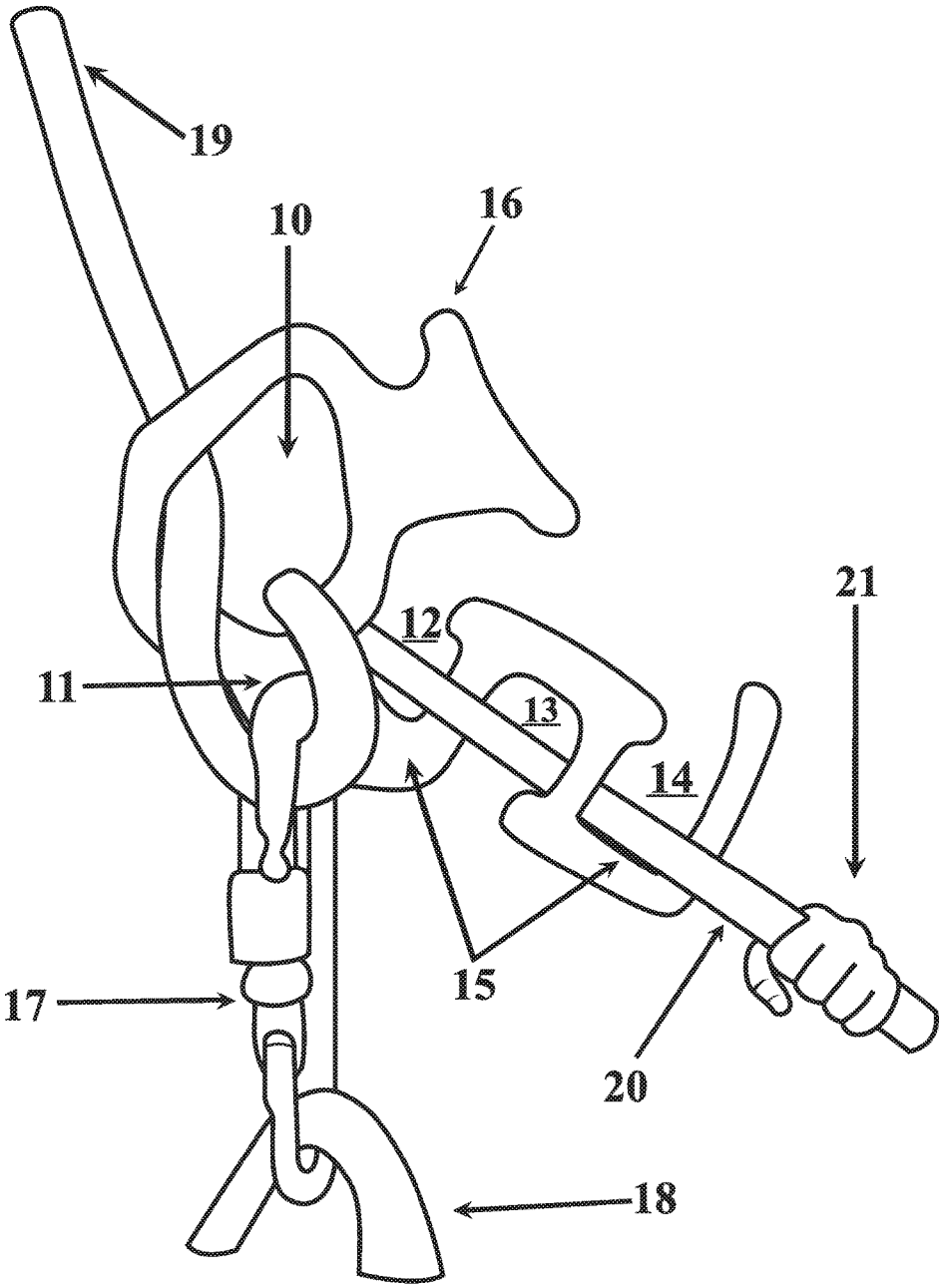
FIG. 6 is a view which depicts the device rigged with rope set ready to control a load and a third additional level of friction added.

Referring to FIG. 6 of the drawings, depicted is the device set with a third additional level of friction. To set the device with a third additional level of friction, attach the device to the load as depicted in FIG. 2, set the device ready to control the load as depicted in FIG. 3, set the device with one additional level of friction as depicted in FIG. 4, set the device with a second additional level of friction as depicted in FIG. 5, a user's hand 21 then pulls the brake strand of rope 20 up into the third opening 14 in the extension 15.

The extension 15 on the device will have at least two openings. Additional openings may be added to the device to allow more friction options without departing from the embodiment of the present invention.

Adjustment up or down throughout the entire range of friction in safe usable increments can be done while the device is weighted. Friction can easily be changed at any time as desired.

Figure 7:
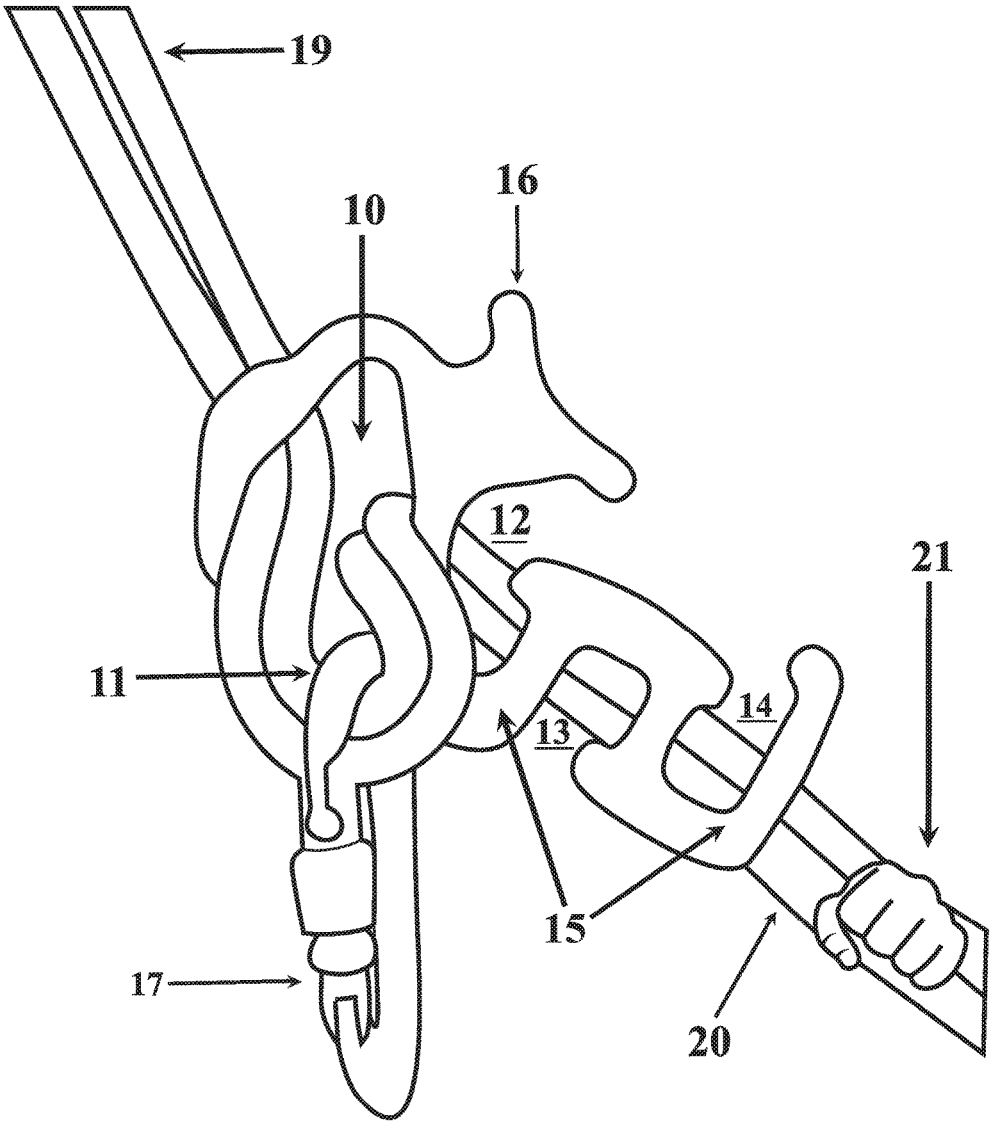
FIG. 7 is a view which depicts the device rigged with two ropes set ready to control a load and the rope is clipped into the carabiner.

Referring to FIG. 7 of the drawings, depicted is the device set ready to control a load using two ropes and the ropes are clipped into the carabiner. To set the device ready to control a load, using two ropes attach the device to the load as depicted in FIG. 2, create a bight in the ropes 19, push the bight through the first hole 10, clip the ropes 19 to the carabiner 17.

Figure 8:
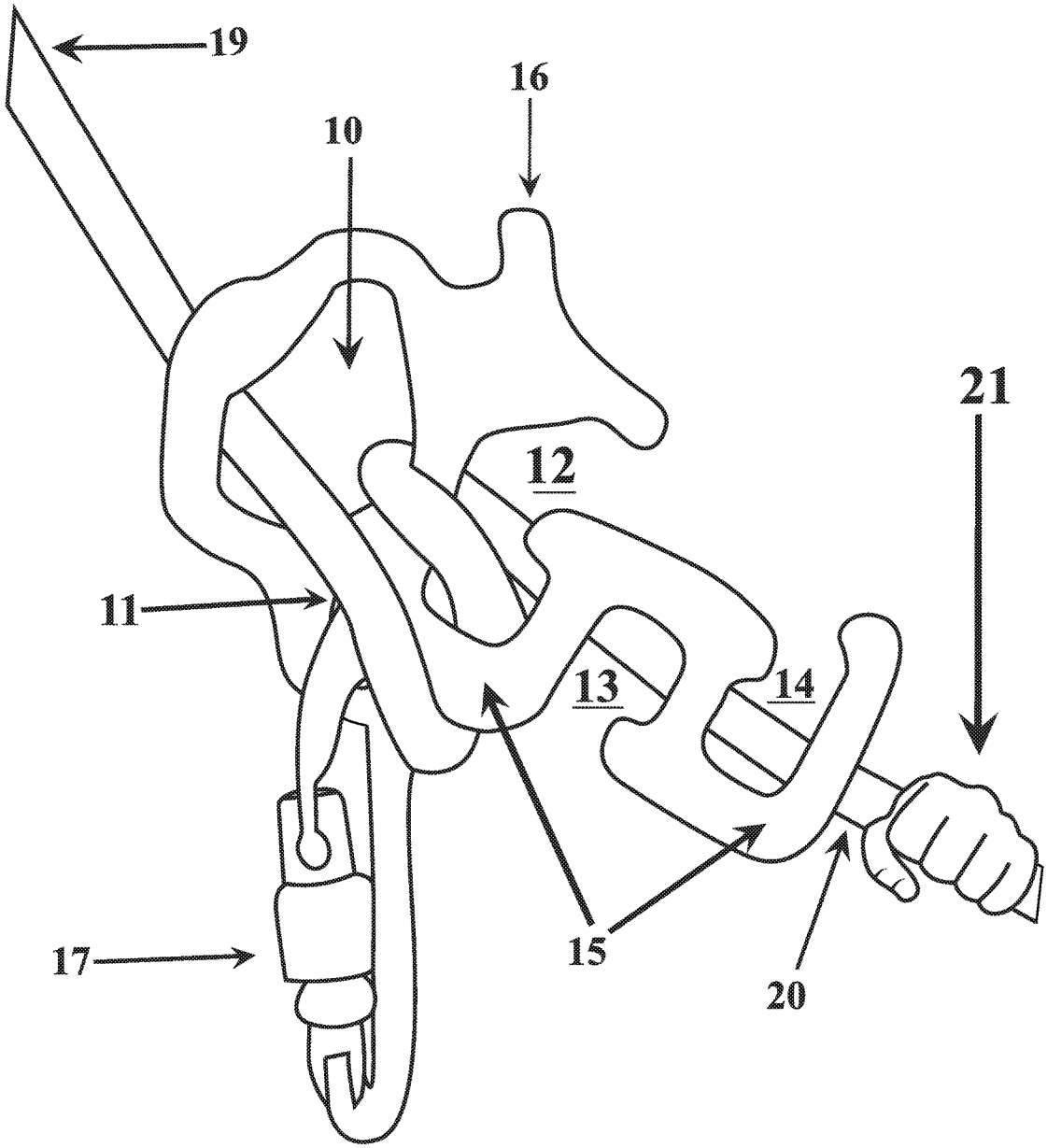
FIG. 8 is a view which depicts the device rigged with a single rope set ready to control a load and the bight of rope is looped around the extension and not clipped into the carabiner.

Referring to FIG. 8 of the drawings, depicted is the device set ready to control a load using a single rope and the bight is looped around the extension and not clipped into the carabiner. To set the device ready to control a load, attach the device to the load as depicted in FIG. 2, create a bight in the rope 19, push the bight through the first hole 10 and loop the bight over the extension 15.

Figure 9:
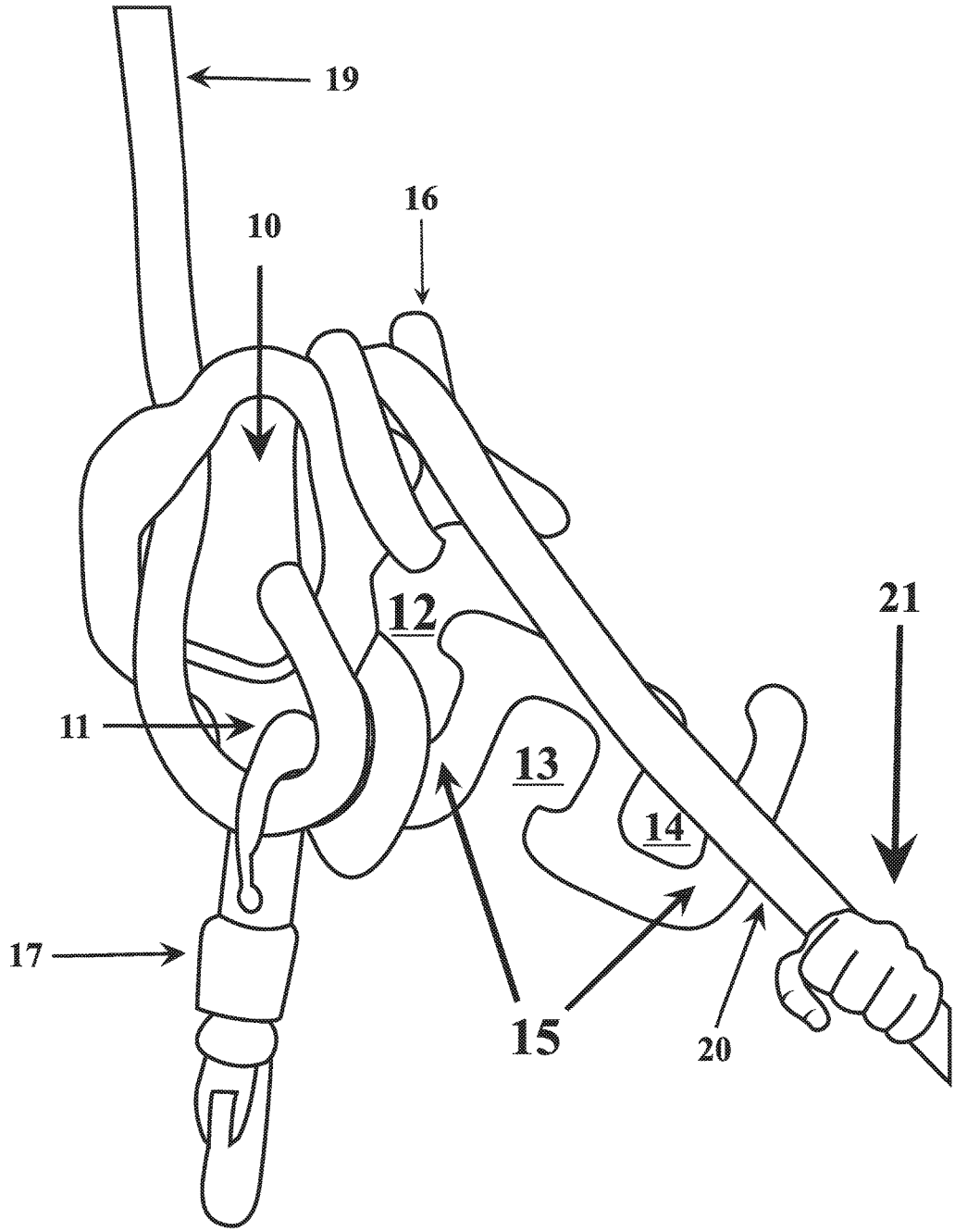
FIG. 9 is a view which depicts the rope weaved around the device and the tab to snub the rope.

Referring to FIG. 9 of the drawings, depicted is the device with rope 19 weaved on the device using the tab 16 to snub the rope.

Figure 10:
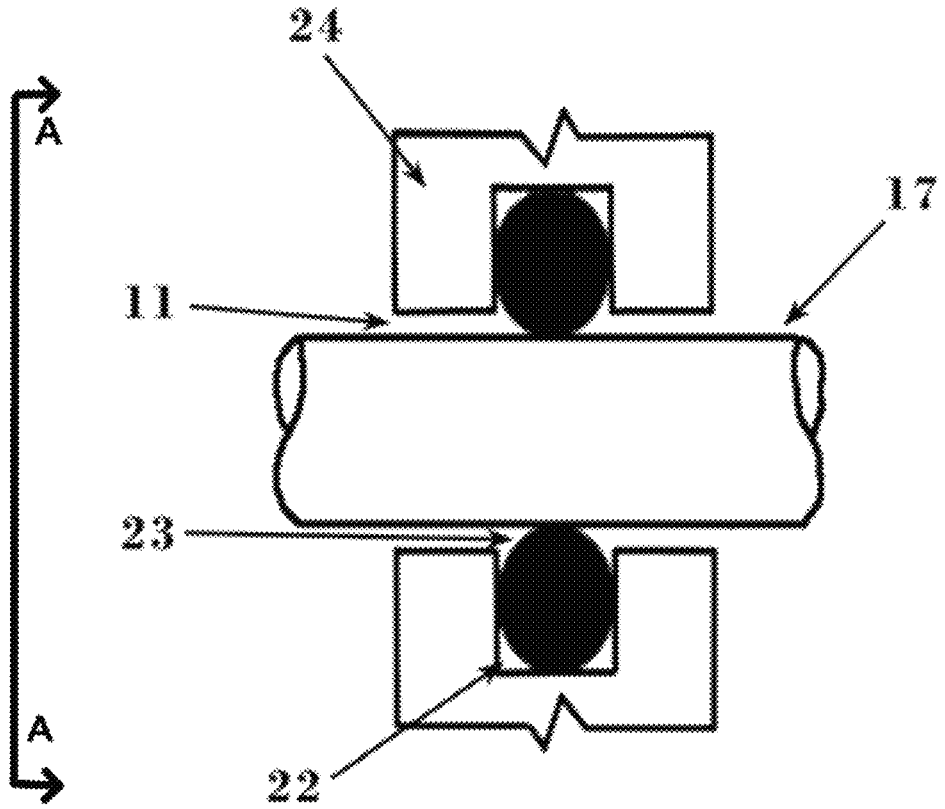
FIG. 10 is a cross sectional view which depicts the gland cut into the inner circumference of the second hole with a carabiner inserted through the second hole and o-ring.

Referring to FIG. 10 of the drawings, depicted is a cross sectional view of the second hole 11 through the device 24 showing the gland 22 which is cut to dimensions suitable to hold an o-ring 23.

Although the present invention has been fully described in conjunction with one possible embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A rappelling device forming a plane, comprising:

a first hole;

a second hole that is separate from the first hole; and an extension that extends from the first hole, the extension having a first side and a second side, the second side being opposite the first side, wherein the extension defines a first semi-enclosed hole that has a first opening positioned on the first side and a second semi-enclosed hole that has a second opening positioned on the second side, wherein the first opening of the first semi-enclosed hole is positioned between the first hole and the second opening of the second semi-enclosed hole, wherein the rappelling device has a longitudinal axis, such that the first hole and each of the semi-enclosed holes are at least partially positioned along and on the longitudinal axis.

2. The rappelling device of claim 1, further comprising a tab that extends outward from the first hole and is positioned adjacent to the first hole.

3. The rappelling device of claim 2, wherein the tab includes a first recess thereon, the first recess configured to receive the rope.

4. The rappelling device of claim 3, wherein the tab further includes a second recess positioned opposite the first recess, the second recess configured to receive the rope.

5. The rappelling device of claim 1, wherein the second hole is positioned adjacent to the longitudinal axis of the rappelling device.

6. The rappelling device of claim 1, wherein the extension forms a sinuous shape.

7. The rappelling device of claim 6, wherein the sinuous shape forms at least an S-shape.

8. The rappelling device of claim 1, further comprising:

a third opening of a third semi-enclosed hole positioned completely on the first side and not on the second side, wherein the second semi-enclosed hole is positioned between the first semi-enclosed hole and the third semi-enclosed hole, the third semi-enclosed hole also being at least partially positioned along and on the longitudinal axis.

9. The rappelling device of claim 8, wherein each of the semi-enclosed holes are positioned adjacent to each other along the longitudinal axis of the extension, and the semi-enclosed holes alternate along the first and second sides of the extension.

10. A rappelling device forming a plane, comprising:

a first hole;

a second hole that is separate from the first hole;

an extension that extends from the first hole, the extension having a first side and a second side, the second side being opposite the first side, wherein the extension defines a first semi-enclosed hole positioned on the first side and a second semi-enclosed hole positioned on the second side, wherein the first semi-enclosed hole is positioned between the first hole and the second semi-enclosed hole; and a gland cut around an inner circumference of the second hole, wherein the gland contains an o-ring made from a compressible resilient material.

11. The rappelling device of claim 10, wherein the first and second semi-enclosed holes of the extension are each configured to receive a rope.

12. The rappelling device of claim 10, further comprising:

a third semi-enclosed hole positioned on the first side of the extension, wherein the second semi-enclosed hole is positioned between the first semi-enclosed hole and the third semi-enclosed hole.

13. The rappelling device of claim 10, further comprising a tab that extends outward from the first hole and is positioned adjacent to the first hole.

14. The rappelling device of claim 13, wherein the tab includes a first recess thereon, the first recess configured to receive the rope.

15. The rappelling device of claim 14, wherein the tab further includes a second recess positioned opposite the first recess, the second recess configured to receive the rope.

* * * * *